US005153946A

United States Patent [19]

Yoke et al.

[11] Patent Number: 5,153,946

[45] Date of Patent: Oct. 13, 1992

[54] APPARATUS AND METHOD FOR AUTOMATICALLY CLOSING A TOILET BOWL LID AND SEAT

[76] Inventors: W. Calvin Yoke, R.R. 1, Box 423, Morristown, Ind. 46161; James H. Yoke, Route 15, Box 396, Acton, Ind. 46259

[21] Appl. No.: 689,302

[22] Filed: Apr. 22, 1991

Related U.S. Application Data

[63] Continuation of Ser. No. 485,479, Feb. 27, 1990, abandoned.

[51] Int. Cl.[5] ..... A47K 13/04; A47K 13/10

[52] U.S. Cl. ..... 4/248; 4/246.1; 188/307

[58] Field of Search ..... 4/236, 240, 248, 251; 188/307

[56] References Cited

U.S. PATENT DOCUMENTS

| | | | |
|---|---|---|---|
| 1,171,169 | 2/1916 | Carter | 188/307 |
| 2,200,687 | 5/1940 | Bercot | 4/251 X |
| 3,404,411 | 10/1968 | Newkirk | 4/251 |
| 3,781,924 | 1/1974 | Davis, Jr. | 4/251 |
| 4,491,989 | 1/1985 | McGrail | 4/251 |
| 4,551,866 | 11/1985 | Hibbs | 4/251 |
| 4,768,630 | 9/1988 | Aubry et al. | 188/307 X |
| 4,914,757 | 4/1990 | Johnson | 4/251 X |
| 4,995,120 | 2/1991 | Tager | 4/251 |
| 5,010,601 | 4/1991 | Kobayashi et al. | 4/236 |

FOREIGN PATENT DOCUMENTS

| | | | |
|---|---|---|---|
| 337477 | 10/1989 | European Pat. Off. | 4/251 |
| 3722114 | 1/1988 | Fed. Rep. of Germany | 4/251 |

*Primary Examiner*—Henry J. Recla
*Assistant Examiner*—Robert M. Fetsuga
*Attorney, Agent, or Firm*—Woodard, Emhardt, Naughton, Moriarty & McNett

[57] ABSTRACT

For use with a toilet having a toilet bowl and a lid mounted to pivot between a closed position covering the bowl and an open position pivoted approximately 90° from the bowl, an apparatus for automatically closing the lid includes a control mechanism engageable with the lid for locking the lid in the open position when the lid is pivoted to the open position and a timer mechanism for actuating the control mechanism to release the lid from the open position after the passage of a predetermined time. Where the toilet includes a toilet seat pivotally mounted to the toilet bowl between the bowl and the lid and is pivotable from a closed position resting atop the bowl, a timer suspension system temporarily suspends operation of the timer mechanism while at least a predetermined weight is applied to the seat in the closed position.

40 Claims, 7 Drawing Sheets

APPARATUS AND METHOD FOR AUTOMATICALLY CLOSING A TOILET BOWL LID AND SEAT

This application is a continuation of application Ser. No. 07/485,479, filed Feb. 27, 1990.

FIELD OF THE INVENTION

The present invention relates to the field of hinged toilet lid assemblies, and in particular to an apparatus for automatically closing a toilet bowl lid.

BACKGROUND OF THE INVENTION

A common complaint associated with free-swinging toilet seats and lids is that one or both is left in the up or open position after use. During the nighttime, the subsequent user, who may be half-asleep and may disregard turning on the lights, is usually startled by sitting directly on or within the rim of the toilet bowl. Some also suggest that proper bathroom etiquette requires that both the lid and the seat be left down or closed when the commode is not in use so that the inside of the bowl is not readily visible or readily accessible to the curious young child or family dog or cat.

Several solutions to this problem have been developed such as the device described in U.S. Pat. No. 4,195,372 which automatically closes the toilet lid after use. There, a simple leaf spring interposed between the toilet seat and its lid ensures that the seat will stay down unless held up by manually lifting it against the reactive force of the spring. In U.S. Pat. No. 1,743,079, a device uses a spring-loaded plunger to automatically close the lid or the lid and the seat unless someone is sitting on the seat, which action temporarily allows the lid to stay open until weight is removed from the seat. In U.S. Pat. No. 1,134,755, a device is disclosed which uses a weighted, pivotally mounted rocker arm to automatically close a toilet lid unless held open. The rocker arm may be temporarily disabled from closing the lid by sitting on the seat. Another device, disclosed in U.S. Pat. No. 1,830,361, prevents the toilet lid from being pivoted to a stable, upright position unless the lid is pushed back far enough, against the bias of a spring, to shift the toilet seat forward. When someone sits on the forward-shifted seat, the lid will remain in the upright position. Upon removing the weight from the seat, a spring system pulls the seat and hinge of the lid rearwardly and Past a gravitationally stable position allowing it to slam shut. In U.S. Pat. Nos. 452,684 and 2,104,947, devices are shown wherein the toilet lid may be pivoted all the way back to a cocked or loaded position which holds the lid open and wherein the toilet seat is pivoted slightly upwards. Upon sitting on the seat, the respective mechanism is advanced to an intermediate stage. When weight is next removed from the seat, the device is triggered from the intermediate stage to automatically pivot the lid closed with the aid of gravity, the '947 device providing a friction disk member for slowing the descent of the lid.

While these devices seem to solve the problem of closing a toilet lid and/or seat after use, they create a number of new problems. Some of the above-described mechanisms will inherently not allow the toilet seat to be raised. Some, while allowing both the seat and lid to be raised in order to use the facility as a urinal, must be manually held in the upright position during use. And a problem with nearly all of these devices is that the lid is automatically caused to close immediately after weight is removed from the toilet seat. A person, especially one who is disabled or handicapped, could be struck by the falling lid if he or she cannot rise quickly enough from the seat.

What is needed is a device which automatically closes the toilet lid and/or seat safely and economically and without substantially inhibiting the normal operation of the standard free-swinging toilet lid and/or seat.

SUMMARY OF THE INVENTION

Generally speaking, the present invention provides a device for holding the toilet lid and/or toilet seat in the up position for a predetermined time and then automatically lowering it at a dampened rate.

For use with a toilet having a toilet bowl and a lid mounted to pivot between a closed position covering the bowl and an open position pivoted approximately 90° from the bowl, an apparatus for automatically closing the lid includes a control mechanism engageable with the lid to lock the lid in the open position when the lid is pivoted to the open position, to wind a timer power spring, and to cock and start a timing mechanism. After a predetermined time, the timing mechanism then to actuates the control mechanism to release the lid from the open position. A retarding mechanism urges initial descent of the lid sufficient for gravity to take over and also dampens the descent of the lid to preclude the lid from slamming shut. Where the toilet includes a toilet seat pivotally mounted to the toilet bowl between the bowl and the lid and is pivotable from a closed position resting atop the bowl, a timer suspension system temporarily suspends operation of the timer mechanism while at least a predetermined weight is applied to the seat in the closed position. The apparatus also provides for adjustment of the predetermined time measured by the timing mechanism.

It is an object of the present invention to provide an improved device for automatically closing the lid of a toilet facility.

It is another object of the present invention to provide a device for automatically closing the lid or seat of a toilet facility after a predetermined time.

Further objects and advantages of the present invention will become apparent from the following description of the preferred embodiment.

DESCRIPTION OF THE PREFERRED EMBODIMENT

Figure 4:
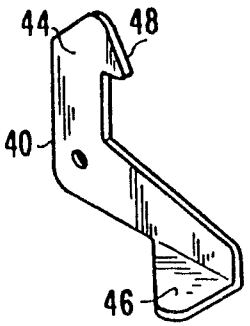
FIG. 4 is a perspective view of the seat catch lever of the apparatus shown in FIG. 2.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1-5, there is shown an apparatus 10 for automatically closing a toilet bowl lid in accordance with the preferred embodiment of the present invention. Apparatus 10 generally includes a housing 11 which is mounted to a toilet bowl 12 just forward of the tank 13. Housing 11 is secured to toilet bowl 12 by conventional anchor bolts 14 which extend downwardly from anchor bolt head slots 14A which are defined in the bottom of housing 11. A control shaft 15 and a fixed shaft 16 extend outwardly from opposite ends of housing 11. A toilet seat 17 and toilet lid 18 are pivotally mounted at shafts 15 and 16 to rotate about the shafts common axis 19. Housing 11 holds the majority of the components of apparatus 10 and comprises a control-retarder enclosure 22, a timer enclosure 23, and left and right end caps 24 and 25, respectively. Enclosures 22 and 23 and end caps 24 and 25 are held tightly together by a number of appropriate bolts 26 which extend longitudinally from one end cap (25) to the other (24). Fixed shaft 16 is an integral extension of right end cap 25. Control shaft 15 cooperates with various components within housing 11 as described herein and extends outwardly through a hole in left end cap 24.

Lid 18 has a pair of outer hinge portions 28A and 28B and seat 17 has a pair of inner hinge portions 27A and 27B. Each of the four hinge portions defines an inwardly extending notch 29 (FIG. 2) which allows each of seat 17 and lid 18 to be slid laterally onto shafts 15 and 16 with the shafts nested firmly within the corresponding notches. The left hinge portion 28A of lid 18 defines a forward screw hole 32 and a rear screw hole 33. Holes 32 and 33 extend through hinge portion 28A, both above and below notch 29. A screw 34 extends through forward hole 32 and through an aligned, diametric hole defined in control shaft 15, thereby securing lid 18 to rotate with shaft 15 about its axis 19. The left hinge portion 27A of seat 17 is provided with similarly aligned forward and rear holes. A screw 35 extends through the rear hole of hinge portion 27A, the screw 35 passing tangentially behind control shaft 15 to secure seat 17 to shaft 15, but to allow it to rotate freely thereabout. Right hinge portions 27B and 28B are also provided with inwardly extending notches and each have only a rear screw hole through which extends a single corresponding screw 36 which passes tangentially behind fixed shaft 16 to hold its respective seat 17 or lid 18 for free rotation about fixed shaft 16. With this arrangement, lid 18 pivots freely about shaft 16 and pivots as a unit with control shaft 15, while seat 17 pivots freely about both fixed shaft 16 and control shaft 15. If it is desired that apparatus 10 automatically close only seat 17, screw 35 would be moved to the forward hole 37 (and through an aligned hole (not shown) in control shaft 15) to lock seat 17 with shaft 15. Also, screw 34 would be moved from forward hole 32 to rear hole 33 to allow lid 18 to pivot freely about shaft 15.

Figure 1:
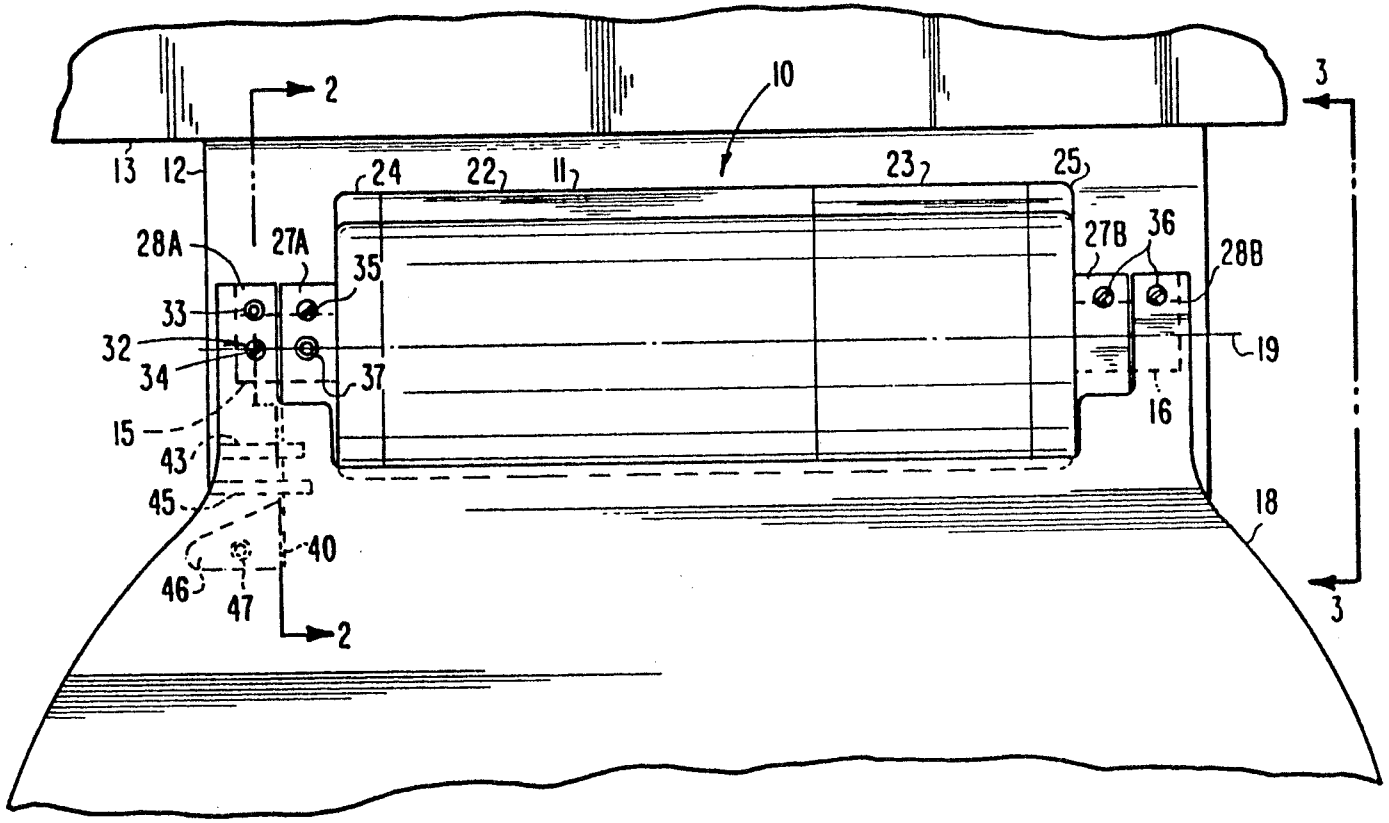
FIG. 1 is plan view of an apparatus for automatically closing a toilet bowl lid in accordance with the preferred embodiment of the present invention and shown mounted to a conventional toilet.
Figure 3:
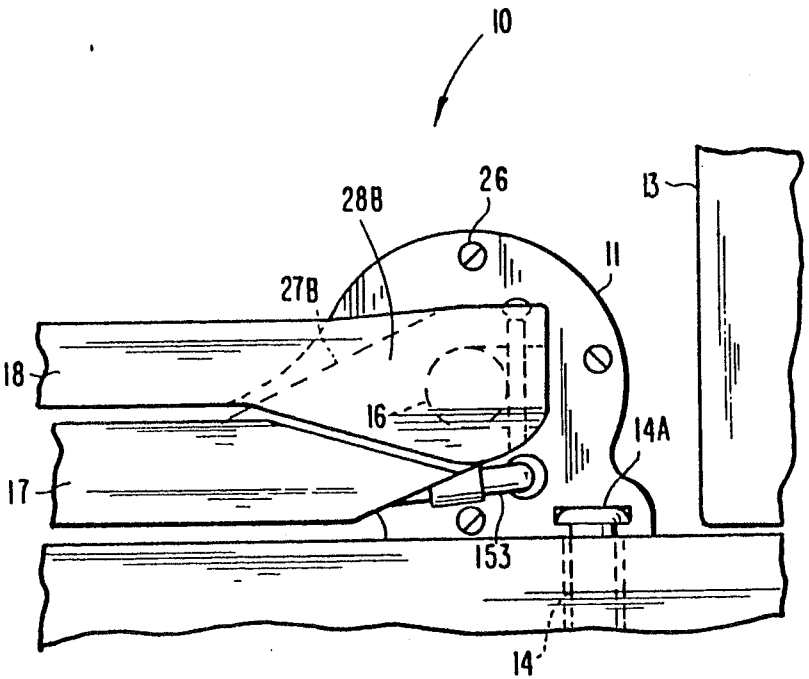
FIG. 3 is a side, elevational view of the apparatus of FIG. 1, taken along the line 3—3 and viewed in the direction of the arrows.
Figure 2:
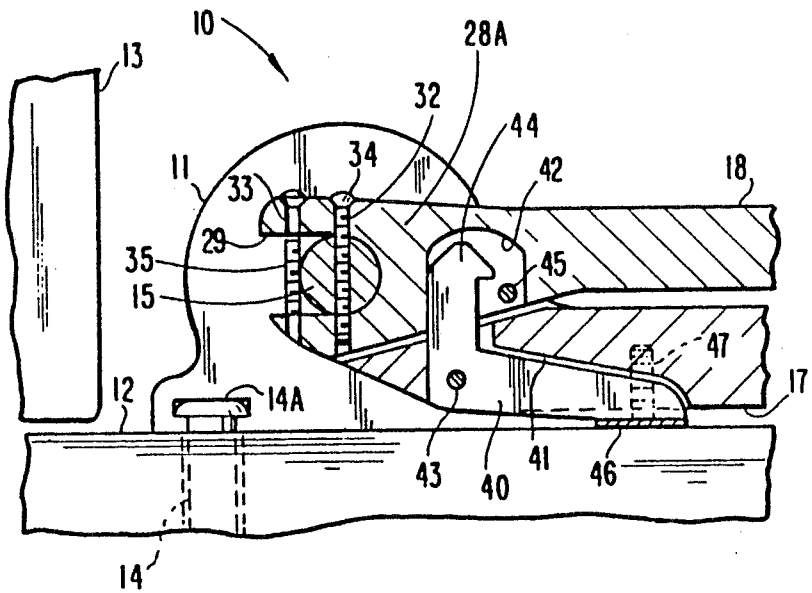
FIG. 2 is a side, cross-sectional view of the apparatus of FIG. 1, taken along the line 2—2 and viewed in the direction of the arrows.

Referring to FIGS. 1, 2 and 4, the present invention includes a generally L-shaped seat catch lever 40 to provide cooperative movement among apparatus 10, seat 17 and lid 18. Seat 17 and lid 18 define appropriately shaped slots 41 and 42, respectively, for receipt of corresponding portions of lever 40 as shown in FIG. 2. Lever 40 is mounted for limited pivotal movement within slot 41 by a horizontally extending pin 43. Lever 40 includes an upper hook portion 44 which extends into slot 42 when lid 18 is pivoted against seat 17. A catch pin 45 extends horizontally into lid 18 and through slot 42. Lever 40 also includes a horizontally extending flange portion 46 which extends orthogonally from rest of flange 40 and rides just below the bottom surface of seat 17. A spring 47 (FIG. 1 and its positionment relative to flange 46 shown in phantom in FIG. 2) is positioned within a bore in the bottom of seat 17. Spring 47 bears against flange 46 to urge seat catch lever 40 clockwise as shown in FIG. 2. When seat 17 is in its closed position, adjacent bowl 12 (FIG. 2), flange 46 contacts the top of bowl 12, pivoting lever 40 counterclockwise against the bias of spring 47. In this Position, lid 18 may be lifted and catch pin 45 of lid 18 will clear hook portion 44 which allows lid 18 to be lifted independently of seat 17. If seat 17 is lifted even slightly, seat catch lever 40 will be pivoted slightly clockwise by spring 47, hook portion 44 will engage with catch pin 45, and lid 18 will be locked to move as a unit with lid 18. A cam surface 48 on hook portion 44 permits lid 18 and seat 17 to be brought together from any position with cam surface 48 engaging catch pin 45 to pivot lever 40 until pin 45 has passed below and locked with hook portion 44. If lid 18 and seat 17 are raised together and it is decided that only lid 18 is to be raised, seat catch lever 40 may be disengaged from lid 18 either by manually depressing flange 46 from below or by closing both lid 18 and seat 17 and then lifting only lid 18.

Figure 5:
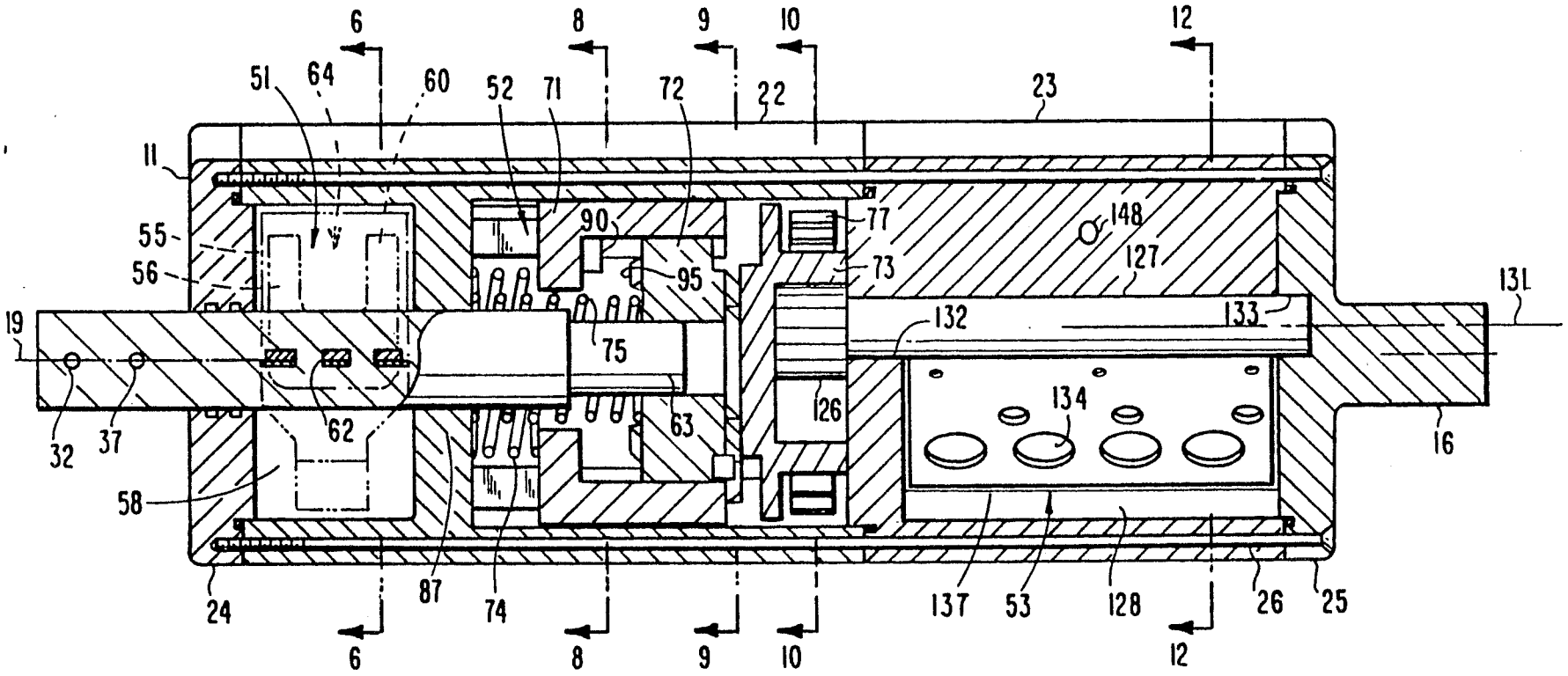
FIG. 5 is a top, cross-sectional view of the apparatus of FIG. 1, the cross-section being taken generally in the horizontal plane through axis 19 of shaft 15.

Referring to FIG. 5, housing 11 contains a retarding mechanism 51, a control mechanism 52 and a timing mechanism 53. In general, retarding mechanism 51 dampens the predominately gravity-powered closing of lid 18; timing mechanism 53 provides an adjustable, mechanical timer with a mechanical output indicating the amount of time that lid 18 has been in the open position and excluding time that weight has been applied to seat 17; and, control mechanism 52 cooperates with timing mechanism 53 and locks seat 18 in the open position, cocks timing mechanism 53, and releases seat 18 when timing mechanism 53 has mechanically indicated passage of a predetermined time.

THE RETARDING MECHANISM

Figure 6:
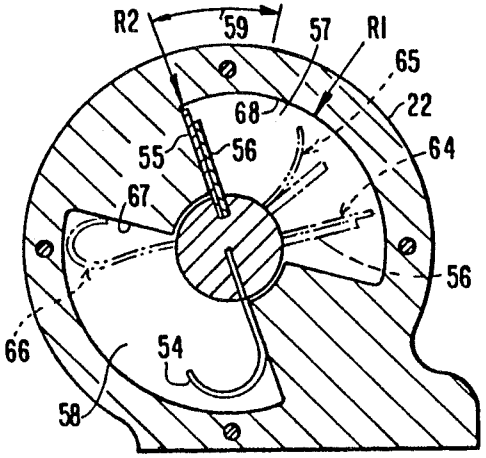
FIG. 6 is a side, cross-sectional view of the apparatus of FIG. 5, taken along the line 6—6 and viewed in the direction of the arrows.

Referring to FIGS. 5 and 6, retarding mechanism 51 includes a retarder chamber 57, a spring return chamber 58, and a retarder vane comprising a retarder spring 55 and a retarder spring support 56. Chambers 57 and 58 are defined by one end of control-retarder enclosure 22 and by left end cap 24. Each chamber 57 and 58 sweeps through an angle of roughly 120° and has a constant width. In one embodiment, the radius R1 of chamber retarder 57 measured from the axis of shaft 15 is 0.9375 inches. Through the last 30° (at 59) of the upper end of retarder chamber 57, the radius gradually decreases from the R1 value down to a value R2 of approximately 0.875 inches.

Retarder spring 55 is made of spring metal while retarder spring support 56 is made of a material such as plastic and is U-shaped and substantially inflexible. Spring 55 and support 56 are fixedly connected to shaft 15 so that, as mounted within housing 11, support 56 and the upper half of spring 55 are mutually adjacent and extend into retarder chamber 57 while the J-shaped lower half 54 extends into spring return chamber 58. In one embodiment, spring 55 and support 56 are provided with mutually aligning holes 62, and shaft 15 is plastic and is molded right around spring 55 and support 56. Holes 62 permit the plastic on both sides of the spring and support to be integrally connected through holes 62, thereby enhancing the strength of the bond between shaft 15 and spring 55 and support 56. The upper half of retarder spring 55 extends from shaft 15 into retarder chamber 57 with a width substantially identical to the width of chamber 57 and a radial length measured from the axis of shaft 15 approximately equal to radius R2. The lower half of spring 55 has a J-shape 54 and a width substantially less than the width of spring return chamber 58. Both chambers 57 and 58 are filled with an appropriate fluid medium such as air or vegetable oil. The cross-section of the majority of shaft 15 is circular while the inner end 63 has a square cross-section.

As described above, lid 18 is secured to shaft 15 with a bolt 34 through hole 32 to rotate as a unit therewith. When lid 18 is in the closed position (FIG. 2), spring 55 and support 56 are positioned within chambers 57 and 58 as shown in solid lines in FIG. 6. When seat 17 is lifted (that is, pivoted about axis 19), shaft 15, spring 55 and support 56 are rotated clockwise (as shown in FIG. 6) through an angle of roughly 95° and to the open position indicated at 64 and shown in phantom in FIGS. 5 and 6. Because there is little clearance between the upper portion of retarder spring 55 and the interior walls of retarder chamber 57, a drag force against clockwise rotation of retarder spring 55 through chamber 57 is created. The elasticity of spring 55, however, allows it to bend backwardly (at 65) as support 56 continues to rotate with shaft 15 toward the open position at 64. As the elasticity of the upper half of spring 55 urges it toward the open position at 64, the fluid in chamber 57 moves around spring 55 and spring 55 slowly moves toward and joins support 56 at the open position at 64. Another consequence of rotating shaft 15 through its angle of roughly 95° is that the lower, J-shaped half 54 of spring 55 is rotated to its open position (at 66) at which point J-shape 54 meets upper wall 67 of chamber 58 and is deformed, thereby creating a spring-loaded condition for shaft 15 and lid 18. When lid 18 is ultimately released from the open position by control mechanism 52 as described herein, the unloading of stressed J-shape 54 will initially rotate shaft 15 and thereby lid 18 far enough for gravity to take over and urge lid 18 to the closed position. Through the closing stroke, support 56 and the upper half of spring 55 rotate counterclockwise through retarder chamber 57. Drag is again produced as the upper half of spring 55 moves through the oil-filled, nearly identically dimensioned chamber 57. However, unlike the clockwise rotating, opening stroke, support 56 precludes spring 55 from bending rearwardly of the direction of its movement and the drag on spring 55 is sufficient to substantially retard the rotation of spring 55, support 56, shaft 15 and thereby lid 18 (and seat 17 if connected thereto by seat catch lever 40 as described above). Over the last 30° of closing rotation 59, the inner radius of chamber 57 gradually decreases from R1 to R2, which reduces further the clearance between spring 55 and inner wall 68 of chamber 57, which gradually increases the drag and retarding force, and which gradually slows the descent and produces a soft landing of lid 18.

THE CONTROL MECHANISM

Referring to FIGS. 5 and 7 through 11, control mechanism 52 is contained within a shaped cavity 83 defined in an end of control-retarder enclosure 22 opposite retarder chamber 57 and spring return chamber 58. Control mechanism 52 generally includes lid release yoke 71, primary cam 72, timer ring 73, lid release yoke spring 74, primary cam spring 75, a pair of opposing primary shift pins 76, and timer power spring 77. In describing the components of control mechanism 52, the front or front side of a component will be that portion or side which is nearest to right end cap 25 and the rear or rear side will be that which is closest to left end cap 24.

Looking at FIGS. 5 and 7 through 9, yoke 71 has an annular base 80 and a pair of opposing, identical, arcuate arms 81. Base 80 defines a hole 82 through which extends shaft 15 and coaxial primary cam spring 75. The inner end of cavity 83 of enclosure 22 is shaped to receive yoke 71 for sliding reciprocation along axis 19, but to preclude its rotation about axis 19. The distal ends of arms 81 define diametrically opposed cam surfaces 84 and diametrically opposed cam rest platforms 86. Each surface 84 and each platform 86 is substantially planar and orthogonal to axis 19. Cam ramps 85, which lead from surfaces 84 to platforms 86, are on the clockwise side of platforms 86 (as viewed in FIGS. 7 and 9). Three equally spaced apart teeth 90 extend from the front side of base 80 toward right end cap as assembled and shown in FIG. 5, with one tooth 91 of teeth 90 being centered in horizontal plane 92 which cuts through axis 19.

Figure 9:
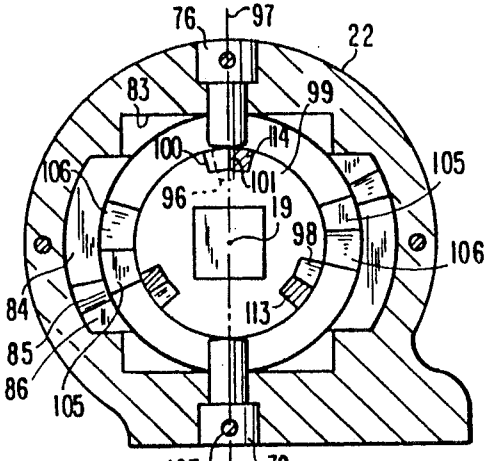
FIG. 9 is a side, cross-sectional view of the apparatus of FIG. 5, taken along the line 9—9 and viewed in the direction of the arrows.
Figure 8:
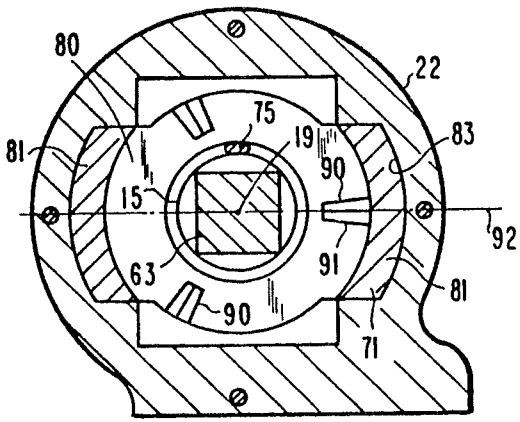
FIG. 8 is a side, cross-sectional view of the apparatus of FIG. 5, taken along the line 8—8 and viewed in the direction of the arrows.
Figure 7:
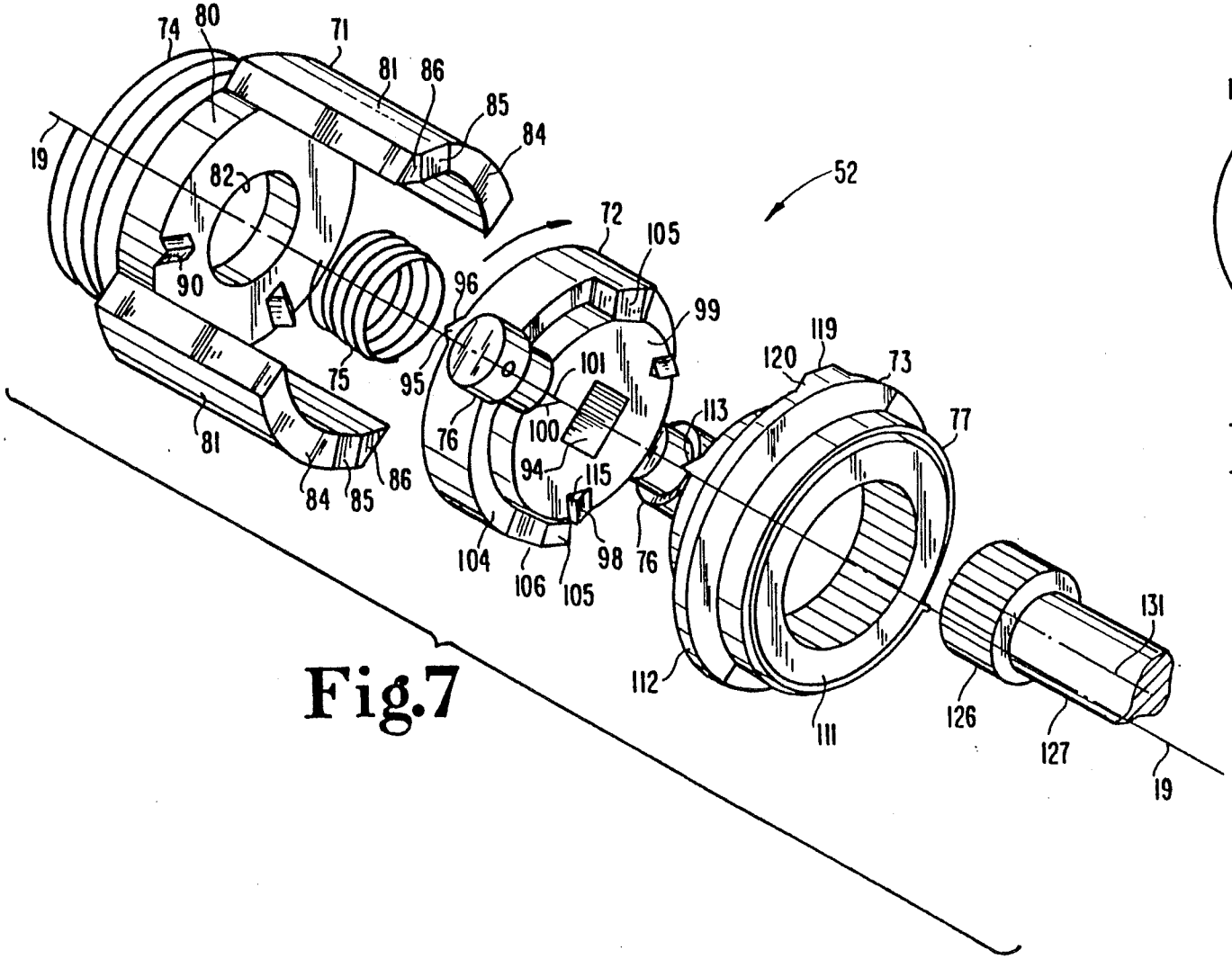
FIG. 7 is an exploded, perspective view of the components of control mechanism 52 of the apparatus of FIG. 5.

Referring to FIGS. 5, 7 and 9, primary cam 72 has a generally round cross-section and is adapted to both rotate and reciprocate axially within and between arcuate arms 81 without restriction therefrom. Cam 72 defines a central, square cross-sectioned opening 94 through which the square cross-sectioned end 63 of shaft 15 can freely, axially reciprocate. The rear side of primary cam 72 defines three teeth 95 (one shown in FIG. 7, the other two shown in FIG. 5) which are disposed 120° apart about axis 19. With control mechanism 52 assembled as shown and in the lid down or closed position, one tooth 96 of teeth 95 is disposed substantially centered in the vertical plane 97 which passes through axis 19. (FIG. 9) Teeth 95 are similar to and are adapted to engage with teeth 90 of lid release yoke 71 as described herein. Three ratchet teeth 98 extend forwardly from the front side 99 of primary cam 72 and are disposed 120° apart. With control mechanism 52 assembled as shown and in the lid down or closed position, one ratchet tooth 100 of teeth 98 is disposed so that its ratchet face 101 (perpendicular to front face 99) lies in vertical plane 97. An annular shoulder 104 is defined substantially completely around front face 99 and is interrupted only by diametrically opposed cam platforms 105. Cam ramps 106, which lead from shoulder 104 to platforms 105, are on the clockwise side of platforms 105 (as viewed in FIGS. 7 and 9). Primary shift pins 76 are mounted in appropriate openings in control-retarder enclosure 22 so that pins 76 extend radially inwardly toward axis 19, the inner ends of pins 76 being adapted to extend into shoulder 104 of primary cam 72 and to engage with ramps 106 and platforms 105 upon appropriate rotation of primary cam 72 as described below. Each pin 76 has a hole 107 in its outer section through which extends one corresponding bolt 26 to hold pin 76 in position.

Figure 10:
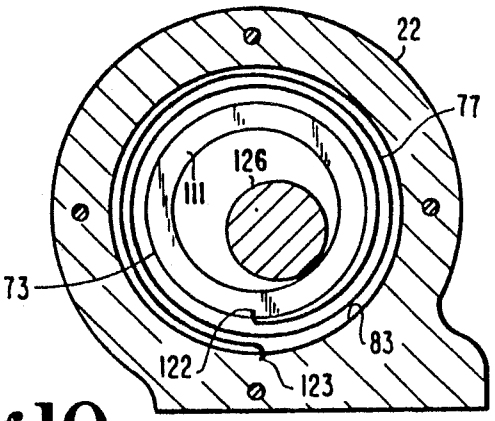
FIG. 10 is a side, cross-sectional view of the apparatus of FIG. 5, taken along the line 10—10 and viewed in the direction of the arrows.
Figure 11:
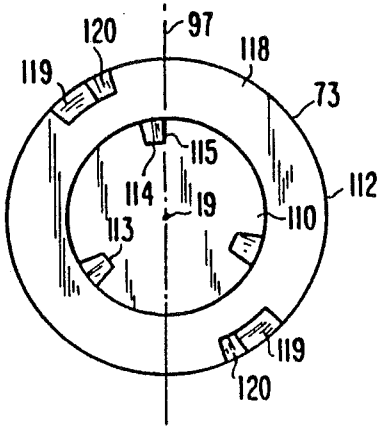
FIG. 11 is an elevational view of the rear face of timer ring 73 of FIG. 7.

Referring to FIGS. 5, 7, 10 and 11, timer ring 73 defines a rear face 110, a forwardly extending ring gear 111 and an annular plate 112 therebetween. Three ratchet teeth 113 extend rearwardly from rear face 110 and are disposed 120° apart about axis 19. With control mechanism 52 assembled as shown and in the lid down or closed position, one tooth 114 of teeth 113 is disposed so that its ratchet face 115 (perpendicular to rear surface 110) lies within vertical plane 97 and engagingly adjacent face 101 of tooth 100 of primary cam 72 (see FIG. 9). Ratchet teeth 113 are disposed so that their ratchet faces 115 all face in the clockwise direction as viewed from the rear (FIG. 11). Likewise, ratchet teeth 98 of primary cam 72 are disposed so that their ratchet faces 101 all face in the clockwise direction as viewed from the front (FIGS. 7 and 9). Outwardly extending annular plate 112 defines an annular shoulder 118 which surrounds rear face 110. A pair of diametrically opposed, ramped platforms 119 extend rearwardly from plate 112 and shoulder 118 with the ramps 120 being on the clockwise side of platforms 119 as viewed from the rear (FIG. 11). At the forward end of control-retarder enclosure 22, the cross-section of cavity 83 is round and adapted to receive timer ring 73 therein.

The outside of rearwardly extending ring gear 111 defines a cylindrical surface around which is wrapped timer power spring 77. Spring 77 is a spiral coil spring and is mounted at one end 122 to ring gear 111. From there, spring 77 spirals outwardly counterclockwise (as viewed in FIG. 10) to its anchored end 123 in enclosure 22. A pinion 126 mounted to the end of timer shaft 127 meshes with ring gear 111.

Primary cam spring 75 coaxially surrounds shaft 15 and extends in compression between bulkhead 87 and primary cam 72 to urge cam 72 forwardly and against timer ring 73. Lid release yoke spring 74 coaxially surrounds primary cam spring 75 and shaft 15 and is disposed in compression between bulkhead 87 and lid release yoke 71 to urge yoke 71 forwardly and against plate 112 of timer ring 73.

From the closed position (lid 18 and seat 17 closed against toilet bowl 12), raising lid 18 (pivoting it about axis 19), rotates shaft 15 which rotates primary cam 72, causing ratchet teeth 98 to engage ratchet teeth 113 and to rotate timer ring 73 about axis 19, which in turn rotates pinion 126 and its timer shaft 127 at a ratio of approximately 1.74 to 1. The lid lifting stroke and consequential rotation of timer ring 73 also winds timer power spring 77. Upon rotation of lid 18 through an angle of roughly 95°, ramped platforms 105 of primary cam 72 engage with shift pins 76 which move primary cam 72 rearwardly and away from timer ring 73. This movement disengages ratchet teeth 98 from ratchet teeth 113 thus allowing timer ring 73 to be rotated by the unwinding of coil spring 77. The rearward movement of primary cam 72 also moves teeth 95 of cam 72 into an engaging position with teeth 90 of yoke 71, the lid lifting stroke having rotated cam 72 enough so that the three teeth 95 have moved just clockwise (as viewed from the front in FIGS. 7 and 8) of teeth 90. Thus, when primary cam 72 is moved rearwardly against annular base 80, teeth 90 of stationary yoke 71 will temporarily lock cam 72, and thereby lid 18, from rotating back to the closed position. Lid 18 is now locked in the open position. As described above, in this position, lid 18 is urged toward the closed position by the deformation of the lower, J-shaped half 54 of spring 55 against upper wall 67 of chamber 58.

Lid 18 may be moved out of this open and locked position in either of two ways. First, because each of teeth 90 of yoke 71 and each of teeth 95 of cam 72 are somewhat beveled on both sides thereof, lid 18 may be manually pulled toward the closed position. The camming action between teeth 90 and 95 created by manually rotating lid 18 and cam 72 toward the closed position pushes yoke 71 rearwardly against the bias of lid release yoke spring 74 until teeth 95 have popped over and past teeth 90, thereby releasing cam 72 from yoke 71. The second way in which lid 18 is released from the open position is through expiration of a preset time at which point timer ring 73 is rotated counterclockwise (as shown in FIGS. 7 and 10 and described below) sufficiently for ramped platforms 119 of ring 73 to engage with ramped platforms 86 of yoke 71, thereby pushing yoke 71 rearwardly and releasing cam 72 from the locked position.

THE TIMING MECHANISM

Figure 12:
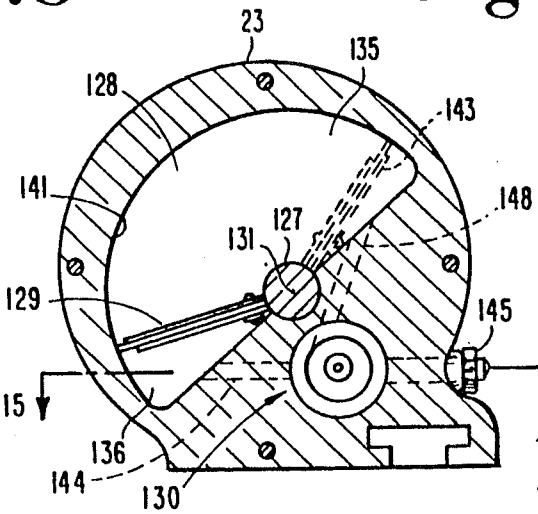
FIG. 12 is a side, cross-sectional view of the apparatus of FIG. 5 taken along the line 12—12 and viewed in the direction of the arrows.
Figure 13:
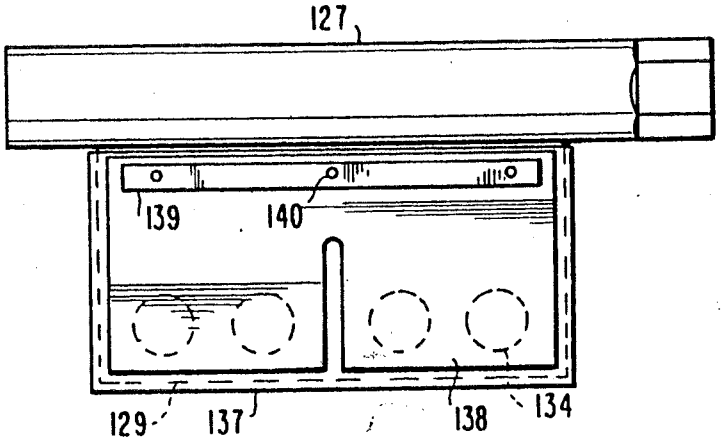
FIG. 13 is a plan view of the shaft and timing vane of the timing mechanism of the apparatus of FIG. 5.
Figure 14:
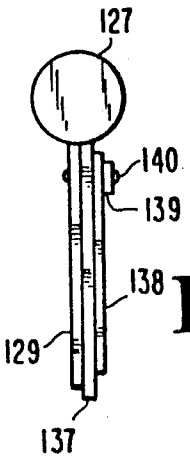
FIG. 14 is a side view of the shaft and timing vane of FIG. 13.
Figure 15:
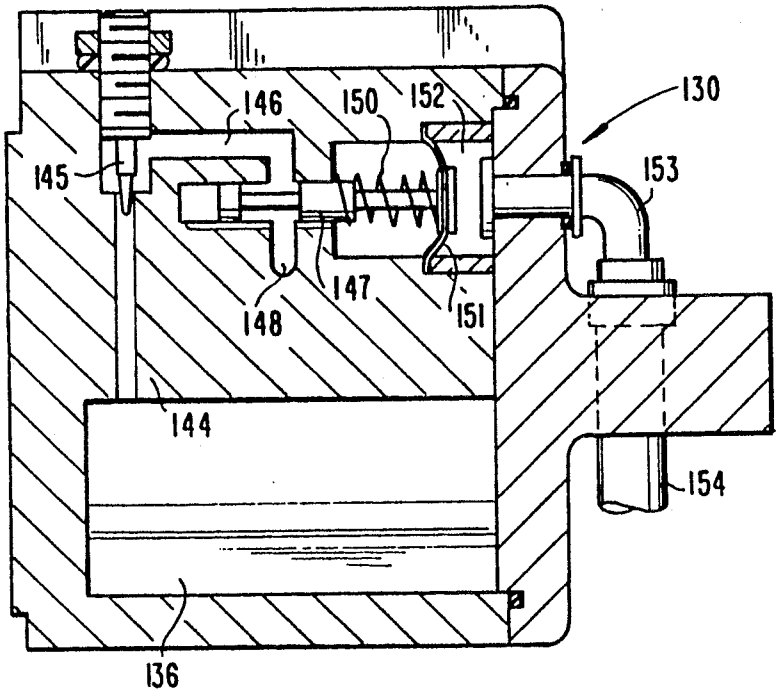
FIG. 15 is a cross-sectional view of a portion of the timing mechanism of the apparatus of FIG. 5, taken along the line 15—15 of FIG. 12 and viewed in the direction of the arrows.

Referring now to FIGS. 5 and 12 through 14, timing mechanism 53 includes timer chamber 128, timer shaft 127, timing vane 129, and a timer suspension valve system 130 (FIGS. 12 and 15). Timer chamber 128, defined by timer enclosure 23 and right end cap 25, has a constant width and constant radius and sweeps through an angle of approximately 180° about the axis 131 of timer shaft 127. Timing vane 129 is welded to shaft 127 and defines a number of flow holes 134. Shaft 127 is mounted in holes 132 and 133 of timer enclosure 123 and right end cap 25, respectively, to allow vane 129 to rotate within chamber 128. As viewed in FIG. 12, the portion of chamber 128 on the clockwise side of vane 129 is referred to herein as the cocking side 135 while the portion on the counterclockwise side of vane 129 is referred to as the timing side 136 of chamber 128. Timing vane 129 is adapted to act as a one-way valve between cocking side 135 and timing side 136 by the addition of a neoprene valve seal 137 and a leaf spring 138 to vane 129 on the timing side 136. A hold-down strip 139 with rivets 140 clamps vane 129, seal 137 and spring 138 sandwiched together. As clamped to vane 129, seal 137 is sized to extend radially and to the sides slightly outwardly from vane 129 (as seen in FIG. 13) and to contact and seal against the interior walls 141 of timer chamber 128, thereby precluding fluid from flowing around the edges of vane 129 in either direction between cocking side 135 and timing side 136. Leaf spring 138 holds seal 137 against the side of vane 129, thereby covering holes 134 and precluding fluid from flowing therethrough. When vane 129 is pivoted clockwise (as viewed in FIG. 12) about axis 131, the fluid pressure acting through flow holes 134 and against seal 137 is sufficient to bend seal 137 away from vane 129 and against the bias of spring 138, thereby allowing fluid to flow from cocking side 135 to timing side 136. When vane 129 reaches its cocked position (at 143), spring 138 returns seal 137 to a sealing position against vane 129.

Figure 17:
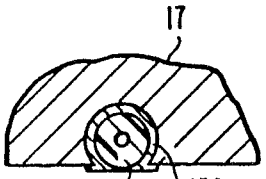
FIG. 17 is a cross-sectional view of seat signal tube 154 of FIG. 16, taken along the line 17—17 and viewed in the direction of the arrows.
Figure 18:
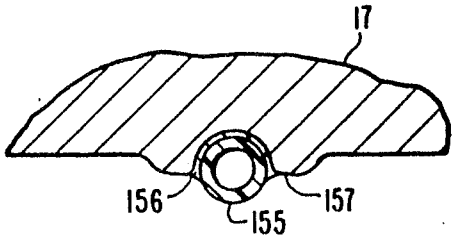
FIG. 18 is a cross-sectional view of sensing tube 155 of FIG. 16, taken along the line 18—18 and viewed in the direction of the arrows.

For vane 129 to be able to rotate counterclockwise to a timed out position, fluid must be permitted to flow from timing side 136 to cocking side 135. Referring to FIGS. 12 and 15, an outlet passage 144 leads from timing side 136 to an adjustable needle valve 145. The outlet 146 from needle valve 145 leads to diaphragm-operated valve member 147 of timer suspension valve system 130. When valve member 147 is open, fluid is allowed to flow from passage 146 through relief passage 148 to the cocking side 135 of vane 129. Valve member 147 is held in the normally open position by a spring 150 and is reciprocated between open and closed positions by pressure variations acting on the right side of diaphragm 151 within signal pressure chamber 152. Pressure chamber 152 is in communication through 0-ring sealed, metal bulkhead tube fitting 153 which is connected to seat signal tube 154. Looking at FIGS. 16 through 19, tube 154 extends into and around to the front of toilet seat 17 and is connected there to a soft plastic sensing tube 155. The majority of the length of tube 154 is appropriately, fixedly sealed in a recess defined in the underside of seat 17 between a shaped recess 160 and its connection to tube 155. Sensing tube 155 is set in soft, flexible caulking 156 in a formed recess 158 (FIG. 17) defined in the underside of seat 17 with a substantial portion extending below the lowest portion 157 of seat 17. When seat 17 is in the down or closed position substantially adjacent to bowl 12, and sufficient weight is placed upon seat 17 such as by a person sitting thereon, sensing tube 155 and the fluid volume contained therein are compressed, which compression is translated through signal tube 154 and back to pressure chamber 152 to exert a force against diaphragm 151 which pushes valve member 147 to the left (as viewed in FIG. 15), against the bias of spring 150, which in turn blocks fluid flow from passage 146 to relief passage 148. Despite the urging of timer power spring 77 to rotate shaft 127 and vane 129, fluid cannot flow from timing side 136 to cocking side 135 around vane 129 or through holes 134, and, with valve member 147 activated to block flow from passage 146 to relief passage 148, the countdown of timing mechanism 53 is temporarily suspended. As soon as weight is removed from atop seat 17 sufficient to allow valve member 147 to open, flow will resume past relief valve 145 and the timing sequence will continue.

In the preferred embodiment, timing mechanism 53 is adapted for an uninterrupted timing stroke of approximately four minutes. By appropriate design of the size of threaded needle valve 145 and its corresponding aperture, the timing stroke value may be made adjustable as desired.

Figure 19:
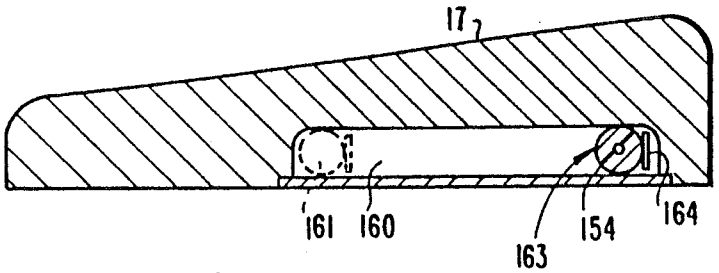
FIG. 19 is a cross-sectional view of seat signal tube 154 within shaped cavity 160 of toilet seat 17 of FIG. 16, taken along the line 19—19 and viewed in the direction of the arrows.
Figure 16:
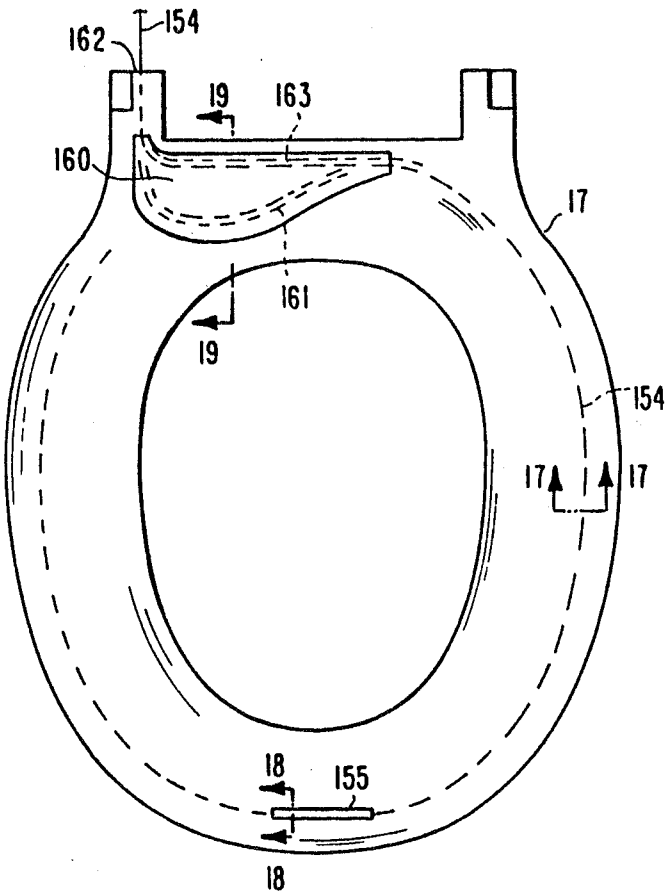
FIG. 16 is a bottom view of a toilet seat showing seat signal tube 154 of timer suspension valve system 130 of FIG. 15.

As shown in FIGS. 16 and 19, shaped cavity 160 is defined in the underside of seat 17 to provide for movement of seat signal tube 154 upon raising and lowering of seat 17. Tube 154 is freely slidable within cavity 160 before being fixed within its recess 158. When seat 17 is down, tube 154 is disposed in the position indicated at 161. When seat 17 is raised, the entry point 162 of seat 17 moves farther from tube fitting 153 at housing 11, and tube 154 is pulled to assume the position indicated at 163. A flat spring 164 (FIG. 19) is provided to constantly urge tube 154 to the seat down position at 161.

Summarizing the entire operation of apparatus 10, with both seat 17 and lid 18 in the closed position as shown in FIG. 2, lid 18 and thereby shaft 15 may be rotated to an open position through an angle of approximately 95°. As a result: retarder spring 55 substantially unrestrictively rotates through chamber 57 to its open position at 64; J-shaped lower half 54 easily rotates through its chamber 58 until deformed against wall 67; primary cam 72 rotates timer ring 73 until cam platforms 105 engage shift pins 76 which moves primary cam 72 rearwardly and out of engagement with timer ring 73 and into engagement with teeth 90 of yoke 71, thereby locking primary cam 72, shaft 15 and lid 18 in the open position; rotation of timer ring 73 winds coil spring 77; and, rotation of timer ring 73, via pinion 126 and shaft 127, substantially unrestrictively rotates timing vane 129 through timer chamber 127 to the cocked position at 143. With no external weight or force being exerted to push seat 17 down, the weight of seat 17 alone is insufficient to compress sensing tube 155, diaphragm operated valve member 147 is in the open position due to spring 150, and fluid is free to flow from the timing side 136 of vane 129, past needle valve 145 and valve member 147, to the cocked side 135 of vane 129, thereby allowing vane 129 to rotate through chamber 128, said rotation being induced by the unwinding force of timer power spring 77. At the end of the closing stroke of timing vane 129 through chamber 128, ramped platforms 119 of timer ring 73 engage platforms 86 of yoke 71 and push yoke 71 rearwardly, thereby disengaging teeth 90 from primary cam 72, which enables free rotation of cam 72 and lid 18. The stressed, J-shaped, lower half 54 of spring 55 rotates shaft 15 and lid 18 far enough for gravity to pull lid 18 down to its closed position. The rotation of lid 18 from the open to closed position is retarded by drag created by spring 55 moving through fluid-filled chamber 57.

When lid 18 is first lifted and locked into the open position, sitting on seat 17 or otherwise exerting a downward force thereon sufficient to compress sensing tube 155 and close valve member 147 will temporarily preclude the rotation of vane 129 through chamber 128, thereby suspending the countdown of timing mechanism 53.

If seat 17 and lid 18 are locked together by seat catch lever 40, they will both be held in the locked, open position by apparatus 10 and will be lowered together slowly by the action of retarding mechanism 51.

Alternative embodiments are contemplated for toilet facilities which have only a seat and do not have a lid or for facilities wherein the seat is inherently not pivotable. In these instances, shaft 15 may be locked to rotate with the described pivotable member and seat catch lever 40 may be connected, removed or disconnected as appropriate.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a toilet having a toilet bowl and a lid member mounted to pivot between a closed position covering the bowl and an open position pivoted approximately ninety degrees from the bowl, an apparatus for automatically closing the lid member, comprising:

control means engageable with the lid member and for releasably locking the lid member in the open position when the lid member is pivoted to the open position;

timer means operable independent of flushing action of the toilet for actuating said control means to release the lid member from the open position after the passage of a predetermined time after locking the lid member in the open position, the predetermined time being greater than zero; and, energy storage means engageable with the lid member and for storing energy degenerated by lifting the lid member, wherein said timer means is powered by said energy storage means, and wherein said energy storage means includes a spiral coil spring connected to said timer means and adapted to be wound upon lifting the lid.

2. The apparatus of claim 4 further including lid member biasing means for biasing the lid member from the open position toward the closed position.

3. The apparatus of claim 1 further including retarding means for damping descent of the lid member.

4. The apparatus of claim 3 further including a housing mountable to the bowl and wherein said retarding means includes a fluid filled retarder chamber defined by said housing and a retarder vane connectable to rotate as a unit with and about the same axis as the lid member and within the chamber.

5. The apparatus of claim 4 wherein the vane is adapted to exert a substantially greater damping force upon the descent of the lid member than on the ascent of the lid.

6. The apparatus of claim 5 wherein the apparatus includes a shaft connectable to rotate with the lid member and wherein the vane comprises a riding support and a retarder spring both connected to rotate with the shaft.

7. The apparatus of claim 1 wherein said timer means is adjustable to vary the predetermined time.

8. The apparatus of claim 1 wherein the lid member is a lid.

9. The apparatus of claim 8 wherein a toilet seat is pivotally mounted to the bowl between the bowl and the lid and is pivotable between a closed position resting atop the bowl and an open position pivoted approximately 90 degrees from the bowl, and wherein the apparatus further includes locking means for locking the lid and the set together whenever the lid and the seat are mutually adjacent away from their closed positions.

10. In a toilet having a toilet bowl and a lid member mounted to pivot between a closed position covering the bowl and an open position pivoted approximately ninety degrees from the bowl, an apparatus for automatically closing the lid member, comprising:

control means engageable with the lid member and for releasably locking the lid member in the open position when the lid member is pivoted to the open position;

timer means operable independent of flushing action of the toilet for actuating said control means to release the lid member from the open position after the passage of a predetermined time after locking the lid member in the open position, the predetermined time being greater than zero; and, timer suspension means for temporarily suspending operation of said timer means and wherein said timer means includes valved fluid flow between chambers and wherein said timer suspension means interrupts said fluid flow.

11. The apparatus of claim 10 wherein the lid member is a lid and wherein a toilet seat is pivotally mounted to the bowl between the bowl and the lid and is pivotable between a closed position resting atop the bowl and an open position pivoted approximately 90 degrees from the bowl, and wherein said timer suspension means temporarily suspends operation of said timer means while at least a predetermined weight is applied to the seat in the closed position.

12. The apparatus of claim 11 wherein said timer means includes:

a timer chamber, a timing vane dividing said chamber into a timing side and a cocking side, and adapted to be pivoted within said chamber by said control means, one way valve means for permitting substantially unrestricted fluid flow from the cocking side to the timing side upon lifting the lid whereby said vane may be rotated in the direction of the cocking side to a cocked position, and timer valve means for permitting restricted fluid flow from the timing side to the cocking side when the lid is locked in the open position whereupon said vane is permitted to rotate at a controlled rate from its cocked position and in the direction of the timing side.

13. In a toilet having a toilet bowl and a lid mounted to pivot between a closed position covering the bowl and an open position pivoted approximately ninety degrees from the bowl, an apparatus for automatically closing the lid, comprising:

control means engageable with the lid and for releasably locking the lid in the open position when the lid is pivoted to the open position;

timer means operable independent of flushing action of the toilet for actuating said control means to release the lid from the open position after the passage of a predetermined time after locking the lid member in the open position, the predetermined time being greater than zero; and, wherein a toilet seat is pivotally mounted to the bowl between the bowl and the lid and is pivotable between a closed position resting atop the bowl and an open position pivoted approximately 90 degrees from the bowl, and wherein the apparatus further includes lid select means for operationally disconnecting said control means from the lid and operationally connecting said control means to the seat.

14. The apparatus of claim 13 further including locking means for locking the lid and the seat together when the lid and the seat are mutually adjacent away from their closed positions.

15. In a toilet having a toilet bowl, an apparatus for automatically closing a toilet bowl lid member, comprising:

a lid member mountable to the bowl to pivot between a closed position covering the bowl and an open position pivoted approximately ninety degrees from the bowl;

control means engaged with the lid and for releasably locking the lid member in the open position when the lid member is pivoted to the open position, said control means permitting virtually instantaneous, manual unlocking of the lid member from the open position;

timer means operable independent of flushing action of the toilet for actuating said control means to release the lid member from the open position after the passage of a predetermined time after locking the lid member in the open position, the predetermined time being greater than zero; and, energy storage means engaged with the lid member and for storing energy generated by lifting the lid member, wherein said timer means is powered by said energy storage means, and wherein said energy storage means includes a spiral coil spring connected to said timer means and adapted to be wound upon lifting the lid member.

16. The apparatus of claim 15 further including lid member biasing means for biasing the lid member from the open position toward the closed position.

17. The apparatus of claim 15 further including retarding means for damping descent of the lid member.

18. The apparatus of claim 17 further including a housing mountable to the bowl and wherein said retarding means includes a fluid filled retarder chamber defined by said housing and a retarder vane connected to rotate as a unit with and about the same axis as the lid member and within the chamber.

19. The apparatus of claim 18 wherein the apparatus includes a shaft connected to rotate with the lid member and wherein the vane comprises a rigid support and a retarder spring both connected to rotate with the shaft.

20. The apparatus of claim 15 wherein the lid member is a lid.

21. The apparatus of claim 20 further including a toilet seat pivotally mountable to the bowl between the bowl and the lid and being pivotable between a closed position resting atop the bowl and an open position pivoted approximately 90 degrees from the bowl, and wherein the apparatus further includes locking means for locking the lid and the seat together whenever the lid and the seat are mutually adjacent away from their closed positions.

22. The apparatus of claim 15 wherein said timer means is adjustable to vary the predetermined time.

23. In a toilet having a toilet bowl, an apparatus for automatically closing a toilet bowl lid member, comprising:

a lid member mountable to the bowl to pivot between a closed position covering the bowl and an open position pivoted approximately ninety degrees from the bowl;

control means engaged with the lid and for releasably locking the lid member in the open position when the lid member is pivoted to the open position, said control means permitting virtually instantaneous, manual unlocking of the lid member from the open position;

timer means operable independent of flushing action of the toilet for actuating said control means to release the lid member from the open position after the passage of a predetermined time after locking the lid member in the open position, the predetermined time being greater than zero; and, timer suspension means for temporarily suspending operation of said timer means and wherein said timer means includes valved fluid flow between chambers and wherein said timer suspension means interrupts said fluid flow.

24. The apparatus of claim 23 wherein the lid member is a lid and wherein the apparatus further includes a toilet seat pivotally mountable to the bowl between the bowl and the lid and being pivotable between a closed position resting atop the bowl and an open position pivoted approximately 90 degrees from the bowl, and wherein said timer suspension means temporarily suspends operation of said timer means while at least a predetermined weight is applied to the seat in the closed position.

25. The apparatus of claim 24 wherein said timer means includes:

a timer chamber, a timing vane dividing said chamber into a timing side and a cocking side, and adapted to be pivoted within said chamber by said control means, one way valve means for permitting substantially unrestricted fluid flow from the cocking side to the timing side upon lifting the lid whereby said vane may be rotated in the direction of the cocking side to a cocked position, and timer valve means for permitting restricted fluid flow from the timing side to the cocking side when the lid is locked in the open position whereupon said vane is permitted to rotate at a controlled rate from its cocked position and in the direction of the timing side.

26. In a toilet having a toilet bowl, an apparatus for automatically closing a toilet bowl lid, comprising:

a lid mountable to the bowl to pivot between a closed position covering the bowl and an open position pivoted approximately ninety degrees from the bowl;

control means engaged with the lid and for releasably locking the lid in the open position when the lid is pivoted to the open position, said control means permitting virtually instantaneous, manual unlocking of the lid from the open position;

timer means operable independent of flushing action of the toilet for actuating said control means to release the lid from the open position after the passage of a predetermined time after locking the lid in the open position, the predetermined time being greater than zero; and, a toilet seat pivotally mountable to the bowl between the bowl and the lid and being pivotable between a closed position resting atop the bowl and an open position pivoted approximately 90 degrees from the bowl, and wherein the apparatus further includes lid select means for operationally disconnecting said control means from the lid and operationally connecting said control means to the seat.

27. The apparatus of claim 26 further including locking means for locking the lid and the seat together when the lid and the seat are mutually adjacent away from their closed positions.

28. In a toilet having a toilet bowl, a method for automatically closing a toilet bowl lid member, comprising:

providing an apparatus for automatically closing a toilet bowl lid member, including:

a lid member mountable to the bowl to pivot between a closed position covering the bowl and an open position pivoted approximately ninety degrees from the bowl;

control means engaged with the lid member and for releasably locking the lid member in the open position when the lid member is pivoted to the open position;

timer means operable independent of flushing action of the toilet for actuating said control means to release the lid member from the open position after the passage of a predetermined time after locking the lid member in the open position, the predetermined time being greater than zero; and, energy storage means engaged with the lid member and for storing energy generated by lifting the lid member, wherein said timer means is powered by said energy storage means, and said energy storage means includes a spiral coil spring connected to said timer means and adapted to be wound upon lifting the lid member;

mounting said apparatus to a toilet bowl so that the lid member can pivot between the open and closed positions; and, actuating said timer means by lifting the lid member toward the open position until said control means locks the lid member in the open position.

29. The method of claim 28 wherein said providing step includes the lid member being a lid.

30. The method of claim 29 wherein said providing step includes said apparatus further including a toilet seat pivotally mountable to the bowl between the bowl and the lid and being pivotable between a closed position resting atop the bowl and an open position pivoted approximately 90 degrees from the bowl, and wherein said apparatus further includes locking means for locking the lid and the seat together whenever the lid and the seat are mutually adjacent away from their closed positions.

31. The method of claim 28 wherein said providing step includes said apparatus further including lid member biasing means for biasing the lid member from the open position toward the closed position.

32. The method of claim 28 wherein said providing step includes said apparatus further including retarding means for damping descent of the lid member.

33. The method of claim 32 wherein said providing step includes said apparatus further including a housing mountable to the bowl and said retarding means including a fluid filled retarder chamber defined by said housing and a retarder vane connected to rotate as a unit with and about the same axis as the lid member and within the chamber.

34. The method of claim 33 wherein said providing step includes said apparatus including a shaft connected to rotate with the lid member and wherein the vane comprises a rigid support and a retarder spring both connected to rotate with the shaft.

35. The method of claim 28 wherein said providing step includes said timer means being adjustable to vary the predetermined time.

36. In a toilet having a toilet bowl, a method for automatically closing a toilet bowl lid member, comprising:

providing an apparatus for automatically closing a toilet bowl lid member, including:

a lid member mountable to the bowl to pivot between a closed position covering the bowl and an open position pivoted approximately ninety degrees from the bowl;

control means engaged with the lid member and for releasably locking the lid member in the open position when the lid member is pivoted to the open position;

timer mean operable independent of flushing action of the toilet for actuating said control means to release the lid member from the open position after the passage of a predetermined time after locking the lid member in the open position, the predetermined time being greater than zero; and timer suspension means for temporarily suspending operation of said timer means and wherein said timer means includes valved fluid flow between chambers and wherein said timer suspension means interrupts said fluid flow;

mounting said apparatus to a toilet bowl so that the lid member can pivot between the open and closed positions; and actuating said timer means by lifting the lid member toward the open position until said control means locks the lid member in the open position.

37. The method of claim 36 wherein said providing step includes the lid member being a lid and said apparatus further including a toilet seat pivotally mountable to the bowl between the bowl and the lid and being pivotable between a closed position resting atop the bowl and an open position pivoted approximately 90 degrees from the bowl, and wherein the timer suspension means temporarily suspends operation of said timer means while at least a predetermined weight is applied to the seat in the closed position.

38. The method of claim 37 wherein said providing step includes said timer means including:

a timer chamber, a timing vane dividing said chamber into a timing side and a cocking side, and adapted to be pivoted within said chamber by said control means, one way valve means for permitting substantially unrestricted fluid flow from the cocking side to the timing side upon lifting the lid whereby said vane may be rotated in the direction of the cocking side to a cocked position, and timer valve means for permitting restricted fluid flow from the timing side to the cocking side when the lid is locked in the open position whereupon said vane is permitted to rotate at a controlled rate from its cocked position and in the direction of the timing side.

39. In a toilet having a toilet bowl, a method for automatically closing a toilet bowl lid, comprising:

providing an apparatus for automatically closing a toilet bowl lid, including:

a lid mountable to the bowl to pivot between a closed position covering the bowl and an open position pivoted approximately ninety degrees from the bowl;

control means engaged with the lid and for releasably locking the lid in the open position when the lid is pivoted to the open position;

timer means operable independent of flushing action of the toilet for actuating said control means to release the lid from the open position after the passage of a predetermined time after locking the lid in the open position, the predetermined time being greater than zero; and, a toilet seat pivotally mountable to the bowl between the bowl and the lid and being pivotable between a closed position resting atop the bowl and an open position pivoted approximately 90 degrees from the bowl, and wherein said apparatus further includes lid select means for operationally disconnecting said control means from the lid and operationally connecting said control means to the seat;

mounting said apparatus to a toilet bowl so that the lid can pivot between the open and closed positions; and, actuating said timer means by lifting the lid toward the open position until said control means locks the lid in the open position.

40. The method of claim 39 wherein said providing step includes said apparatus further including locking means for locking the lid and the seat together when the lid and the seat are mutually adjacent away from their closed positions.

* * * * *